US008193994B2

(12) United States Patent
Alamouti et al.

(10) Patent No.: US 8,193,994 B2
(45) Date of Patent: Jun. 5, 2012

(54) MILLIMETER-WAVE CHIP-LENS ARRAY ANTENNA SYSTEMS FOR WIRELESS NETWORKS

(75) Inventors: Siavash M. Alamouti, Hillsboro, OR (US); Alexander Alexandrovich Maltsev, Nizhny Novgorod (RU); Vadim Sergeyevich Sergeyev, Nizhny, Novgorod (RU); Alexander Alexandrovich Maltsev, Jr., Nizhny Novgorod (RU); Nikolay Vasilevich Chistyakov, Nizhny Novgorod (RU)

(73) Assignee: Intel Corporation, Santa Clara, CA (US)

( * ) Notice: Subject to any disclaimer, the term of this patent is extended or adjusted under 35 U.S.C. 154(b) by 617 days.

(21) Appl. No.: 12/301,693

(22) PCT Filed: May 23, 2006

(86) PCT No.: PCT/RU2006/000256

§ 371 (c)(1),
(2), (4) Date: Apr. 24, 2009

(87) PCT Pub. No.: WO2007/136289

PCT Pub. Date: Nov. 29, 2007

(65) Prior Publication Data

US 2009/0315794 A1 Dec. 24, 2009

(51) Int. Cl.
*H01Q 19/06* (2006.01)

(52) U.S. Cl. ..... 343/753; 343/754; 343/909

(58) Field of Classification Search ..... 343/753, 343/754, 755, 909, 911 R

See application file for complete search history.

(56) References Cited

U.S. PATENT DOCUMENTS

| | | | | |
|---|---|---|---|---|
| 3,922,682 | A | 11/1975 | Hyde | |
| 4,224,626 | A | 9/1980 | Sternberg | |
| 4,321,604 | A * | 3/1982 | Ajioka | 343/753 |
| 5,206,658 | A | 4/1993 | Wokurka | |
| 5,276,277 | A | 1/1994 | Hightower et al. | |
| 5,426,443 | A | 6/1995 | Jenness, Jr. | |
| 5,697,063 | A | 12/1997 | Kishigami et al. | |
| 6,018,659 | A | 1/2000 | Ayyagari et al. | |
| 6,320,538 | B1 | 11/2001 | Lalezari et al. | |
| 6,463,090 | B1 | 10/2002 | Dorfman | |
| 7,085,595 | B2 | 8/2006 | Kitchin | |
| 7,130,904 | B2 | 10/2006 | Kitchin | |
| 7,133,374 | B2 | 11/2006 | Lo et al. | |
| 7,190,324 | B2 * | 3/2007 | Henderson | 343/909 |
| 7,216,166 | B2 | 5/2007 | Sugauchi et al. | |

(Continued)

FOREIGN PATENT DOCUMENTS

CN 1331895 A 1/2002

(Continued)

OTHER PUBLICATIONS

"U.S. Appl. No. 11/452,710, Final Office Action mailed Dec. 11, 2009", 20 pgs.

(Continued)

*Primary Examiner* — Hoang V Nguyen
(74) *Attorney, Agent, or Firm* — Schwegman, Lundberg & Woessner, P.A.; Gregory J. Gorrie

(57) ABSTRACT

Embodiments of chip-lens array antenna systems are described. In some embodiments, the chip-lens array antenna systems (100) may comprise a millimeter-wave lens (104), and a chip-array antenna (102) to generate and direct millimeter-wave signals through the millimeter-wave lens (104) for subsequent transmission.

20 Claims, 6 Drawing Sheets

U.S. PATENT DOCUMENTS

| | | | |
|---|---|---|---|
| 7,245,879 | B2 | 7/2007 | Sadri et al. |
| 7,260,392 | B2 | 8/2007 | Kitchin |
| 7,286,606 | B2 | 10/2007 | Maltsev et al. |
| 7,324,605 | B2 | 1/2008 | Maltsev et al. |
| 7,333,556 | B2 | 2/2008 | Maltsev et al. |
| 7,336,716 | B2 | 2/2008 | Maltsev et al. |
| 7,349,436 | B2 | 3/2008 | Maltsev et al. |
| 7,352,696 | B2 | 4/2008 | Stephens et al. |
| 7,366,471 | B1 | 4/2008 | Kitchin |
| 7,948,428 | B2 | 5/2011 | Lovberg et al. |
| 2001/0026246 | A1 | 10/2001 | Burnside et al. |
| 2002/0154656 | A1 | 10/2002 | Kitchin |
| 2003/0228857 | A1 | 12/2003 | Maeki |
| 2004/0003059 | A1 | 1/2004 | Kitchin |
| 2004/0024871 | A1 | 2/2004 | Kitchin |
| 2004/0061645 | A1 | 4/2004 | Seo et al. |
| 2004/0100981 | A1 | 5/2004 | Kitchin |
| 2004/0120301 | A1 | 6/2004 | Kitchin |
| 2004/0120428 | A1 | 6/2004 | Maltsev et al. |
| 2004/0127245 | A1 | 7/2004 | Sadri et al. |
| 2004/0242275 | A1 | 12/2004 | Corbett et al. |
| 2005/0031047 | A1 | 2/2005 | Maltsev et al. |
| 2005/0032478 | A1 | 2/2005 | Stephens et al. |
| 2005/0058057 | A1 | 3/2005 | Maltsev et al. |
| 2005/0058095 | A1 | 3/2005 | Sadri et al. |
| 2005/0068895 | A1 | 3/2005 | Stephens et al. |
| 2005/0068900 | A1 | 3/2005 | Stephens et al. |
| 2005/0135493 | A1 | 6/2005 | Maltsev et al. |
| 2005/0140563 | A1 | 6/2005 | Eom et al. |
| 2005/0141406 | A1 | 6/2005 | Maltsev et al. |
| 2005/0141412 | A1 | 6/2005 | Sadri et al. |
| 2005/0141657 | A1 | 6/2005 | Maltsev et al. |
| 2005/0143125 | A1 | 6/2005 | Maltsev et al. |
| 2005/0147076 | A1 | 7/2005 | Sadowsky et al. |
| 2005/0152328 | A1 | 7/2005 | Sadri et al. |
| 2005/0152466 | A1 | 7/2005 | Maltsev et al. |
| 2005/0157638 | A1 | 7/2005 | Maltsev et al. |
| 2005/0161753 | A1 | 7/2005 | Huff et al. |
| 2005/0190800 | A1 | 9/2005 | Maltsev et al. |
| 2005/0286544 | A1 | 12/2005 | Kitchin et al. |
| 2005/0287978 | A1 | 12/2005 | Maltsev et al. |
| 2006/0007898 | A1 | 1/2006 | Maltsev et al. |
| 2006/0067426 | A1 | 3/2006 | Maltsev et al. |
| 2006/0114816 | A1 | 6/2006 | Maltsev et al. |
| 2007/0091988 | A1 | 4/2007 | Sadri et al. |
| 2007/0097891 | A1 | 5/2007 | Kitchin |
| 2007/0099668 | A1 | 5/2007 | Sadri et al. |
| 2007/0099669 | A1 | 5/2007 | Sadri et al. |
| 2007/0287384 | A1 | 12/2007 | Sadri et al. |
| 2009/0219903 | A1 | 9/2009 | Alamouti et al. |
| 2010/0033390 | A1 | 2/2010 | Alamouti et al. |
| 2010/0156721 | A1 | 6/2010 | Alamouti et al. |
| 2010/0231452 | A1 | 9/2010 | Babakhani et al. |

FOREIGN PATENT DOCUMENTS

| | | | |
|---|---|---|---|
| DE | 03840451 | | 6/1990 |
| EP | 0212963 | | 3/1987 |
| EP | 0212963 | A2 | 3/1987 |
| EP | 0548876 | A1 | 6/1993 |
| EP | 1077508 | A2 | 2/2001 |
| EP | 1085599 | A2 | 3/2001 |
| EP | 1650884 | A1 | 4/2006 |
| FR | 2569906 | | 3/1986 |
| JP | 61065605 | | 4/1986 |
| JP | 06200584 | | 7/1994 |
| JP | 08-084107 | | 3/1996 |
| JP | 8-84107 | A | 3/1996 |
| JP | 08321799 | | 12/1996 |
| JP | 09051293 | | 2/1997 |
| JP | 11055174 | | 2/1999 |
| JP | 2000165959 | | 6/2000 |
| JP | 2001308797 | | 11/2001 |
| JP | 2002534022 | | 10/2002 |
| JP | 2003124942 | | 4/2003 |
| JP | 2005244362 | | 9/2005 |
| KR | 20060029001 | | 4/2006 |
| WO | 9610277 | A1 | 4/1996 |
| WO | WO-0038452 | A1 | 1/2000 |
| WO | WO-0231908 | A2 | 4/2002 |
| WO | 2004114546 | A1 | 12/2004 |
| WO | WO-2004114546 | A1 | 12/2004 |
| WO | WO-2005050776 | A2 | 6/2005 |
| WO | WO-2005114785 | A1 | 12/2005 |
| WO | WO-2007136289 | A1 | 11/2007 |
| WO | WO-2007136290 | A1 | 11/2007 |
| WO | WO-2007136292 | A1 | 11/2007 |
| WO | WO-2007136293 | A1 | 11/2007 |
| WO | WO-2007146733 | A1 | 12/2007 |

OTHER PUBLICATIONS

"U.S. Appl. No. 11/452,710, Response filed Mar. 9, 2010 to Final Office Action mailed Dec. 11, 2009", 12 pgs.

"European Application No. 06824417.7, Office Action mailed Aug. 14, 2009", 2 pgs.

"European Application No. 06824418.5, Office Action Mailed Jul. 29, 2009", 5.

"European Application No. 06824430.0, Office Action mailed Aug. 24, 2009", 3.

Wu, Xidong, et al., "Design and characterization of single- and multiple beam mm-wave circularly polarized substrate lens antennas for wireless communications", *IEEE Transactions on Microwave Theory and Techniques*, 49(3), (Mar. 2001), 431-441.

Fernandes, J., et al., "Impact of Shaped Lens antennas on MBS Systems", *Personal, indoor and Mobile Radio Communications*, 2(8), (Sep. 8, 1998), 744-748.

Holzman, E.L., "A highly compact 60-GHz lens-corrected conical horn antenna", *IEEE Antennas and Wireless Propagation Letters*, 3(1), (2004), 280-282.

Ueda, T., et al., "An efficeint MAC protocol with direction finding scheme in wireless ad hoc network using directional antenna", *IEEE Proceedings Radio and Wireless Conference*, 2003, RAWCON apos; 03., (2003), 233-236.

Ueda, Tetsuro, et al., "An Efficient MAC Protocol with Direction Finding Scheme in Wireless Ad Hoc Network Using Directional Antenna", *Proceedings, Radio and Wireless Conference*, 2003., (Aug. 10-13, 2003), 4 pgs.

Wu, X., et al., "Design and Characterization of Single-and Multiple-Beam MM-Wave Circularly Polarized Substrate Lens Antennas for Wireless Communications", *IEEE Transactions on Microwave Theory and Techniques*, 49(3), (Mar. 2001), 2001-2003.

"U.S. Appl. No. 11/452,710, Response filed Jun. 1, 2011 to Advisory Action mailed May 6, 2011", 13 pgs.

"U.S. Appl. No. 12/301,556, Preliminary Amendment mailed Nov. 19, 2008", 3 pgs.

"U.S. Appl. No. 12/301,669, Preliminary Amendment filed Jan. 8, 2010", 3 pgs.

"U.S. Appl. No. 12/301,792, Preliminary Amendment filed Nov. 21, 2008", 3 pgs.

"Canadian Application Serial No. 200680054319.6, Office Action mailed Jun. 28, 2011", 14 pgs.

"European Application Serial No. 06824430.0, Office Action mailed Apr. 28, 2011", 6 pgs.

"Japanese Application No. 2009510911, Office Action mailed Jul. 5, 2011", 2 pgs.

"Japanese Application Serial No. 2009-510911, Response filed May 2, 2011 to Non Final Office Action mailed Feb. 1, 2011", with English translation, 9 pgs.

"Japanese Application Serial No. 2009-515577, Office Action mailed May 31, 2011", 6 pgs.

"Chinese Application Serial No. 200680054323.2, Office Action mailed Mar. 17, 2011", with English translation, 11 pgs.

"European Application No. 06824418.5, Response filed Feb. 8, 2010 to Office Action mailed Jul. 29, 2009", 2 pgs.

"European Application Serial No. 06824430.0, Office Action mailed Apr. 15, 2010", 5 pgs.

"European Application Serial No. 06824430.0, Response filed Feb. 8, 2010 to Office Action mailed Jul. 29, 2009", 2 pgs.

"European Application Serial No. 06835789.6, Office Action mailed Aug. 17, 2009", 2 pgs.

"Japanese Application Serial No. 2009-510911, Office Action mailed Feb. 1, 2011", with English translation, 8 pgs.
"U.S. Appl. No. 11/452,710, Non Final Office Action mailed Aug. 22, 2011", 21 pgs.
"U.S. Appl. No. 11/452,710, Response filed Nov. 22, 2011 to Non Final Office Action mailed Aug. 22, 2011", 15 pgs.
"U.S. Appl. No. 12/301,556, Notice of Allowability mailed Dec. 8, 2011", 2 pgs.
"U.S. Appl. No. 12/301,556, Notice of Allowance mailed Nov. 28, 2011", 8 pgs.
"U.S. Appl. No. 12/301,556, Response filed Oct. 28, 2011 to Restriction Requirement mailed Sep. 29, 2011", 8 pgs.
"U.S. Appl. No. 12/301,556, Restriction Requirement mailed Sep. 29, 2011", 7 pgs.
"U.S. Appl. No. 12/301,669 , Response filed Nov. 23, 2011 to Non Final Office Action mailed Aug. 24, 2011", 8 pgs.
"U.S. Appl. No. 12/301,669, Non Final Office Action mailed Aug. 24, 2011", 8 pgs.
"Chinese Application Serial No. 200680054314.3, Office Action mailed Jul. 4, 2011", 5 pgs.
"Chinese Application Serial No. 200680054334.0, Office Action mailed Sep. 21, 2011", W/ English Translation, 12 pgs.
"Chinese Application Serial No. 200680054319.6, Office Action Response filed Oct. 28, 2011", 12 pgs.
"European Application Serial No. 06824417.7, Response filed Jan. 12, 2010 to Office Action mailed Aug. 14, 2009", 13 pgs.
"European Application Serial No. 06824430.0, Response filed Mar. 3, 2010 to Office Action mailed Aug. 24, 2009", 17 pg.
"European Application Serial No. 06824430.0, Response filed Aug. 30, 2011 to Non Final Office Action dated Apr. 28, 2011", 3 pgs.
"European Application Serial No. 06835789.6, Response filed Feb. 8, 2010 to Office Action mailed Aug. 17, 2009", 36 pgs.
"International Application Serial No. PCT/RU2006/000256, International Preliminary Report on Patentability mailed Dec. 11, 2008", 8 pgs.
"International Application Serial No. PCT/RU2006/000256, International Search Report and Written Opinion mailed Feb. 27, 2007", 13 pgs.
"International Application Serial No. PCT/RU2006/000257, International Preliminary Report on Patentability mailed Dec. 11, 2008", 10 pgs.
"International Application Serial No. PCT/RU2006/000257, International Search Report and Written Opinion mailed Jun. 18, 2007", 17 pgs.
"International Application Serial No. PCT/RU2006/000257, Partial International Search Report mailed Mar. 12, 2007", 5 pgs.
"International Application Serial No. PCT/RU2006/000315, International Preliminary Report on Patentability mailed Dec. 11, 2008", 7 pgs.
"International Application Serial No. PCT/RU2006/000315, International Search Report and Written Opinion mailed Mar. 7, 2007", 13 pgs.
"International Application Serial No. PCT/RU2006/000316, International Preliminary Report on Patentability mailed Dec. 11, 2008", 9 pgs.
"International Application Serial No. PCT/RU2006/000316, International Search Report and Written Opinion mailed Mar. 21, 2007", 13 pgs.
"International Application Serial No. PCT/US2007/070588, International Search Report and Written Opinion mailed Oct. 25, 2007", 10 pgs.

* cited by examiner (TOP VIEW)

(SIDE VIEW)

(TOP VIEW)

(SIDE VIEW)

(SIDE VIEW)

(TOP VIEW)

(SIDE VIEW)

(TOP VIEW)
MULTI-SECTOR CHIP-LENS ARRAY ANTENNA

MILLIMETER WAVE COMMUNICATION SYSTEM

MILLIMETER-WAVE CHIP-LENS ARRAY ANTENNA SYSTEMS FOR WIRELESS NETWORKS

This application is a U.S. National Stage Filing under 35 U.S.C. 371 from International Application No. PCT/RU2006/000256, filed May 23, 2006 and published in English as WO 2007/136289 on Nov. 29, 2007, which application and publication are incorporated herein by reference in their entireties.

RELATED APPLICATIONS

This patent application relates to International Application No. PCT/RU2006/000257, filed May 23, 2006 and published in English as WO 2007/136290 on Nov. 29, 2007.

TECHNICAL FIELD

Some embodiments of the present invention pertain to wireless communication systems that use millimeter-wave signals. Some embodiments relate to antenna systems.

BACKGROUND

Many conventional wireless networks communicate using microwave frequencies generally ranging between two and ten gigahertz (GHz). These systems generally employ either omnidirectional or low-directivity antennas primarily because of the comparatively long wavelengths of the frequencies used. The low directivity of these antennas may limit the throughput of such systems. Directional antennas could improve the throughput of these systems, but the wavelength of microwave frequencies make compact directional antennas difficult to implement. The millimeter-wave band may have available spectrum and may be capable of providing higher throughput levels.

Thus, there are general needs for compact directional millimeter-wave antennas and antenna systems suitable for use in wireless communication networks. There are also general needs for compact directional millimeter-wave antennas and antenna systems that may improve the throughput of wireless networks.

DETAILED DESCRIPTION

The following description and the drawings sufficiently illustrate specific embodiments of the invention to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in, or substituted for, those of other embodiments. Embodiments of the invention set forth in the claims encompass all available equivalents of those claims. Embodiments of the invention may be referred to herein, individually or collectively, by the term "invention" merely for convenience and without intending to limit the scope of this application to any single invention or inventive concept if more than one is in fact disclosed.

Figure 1A:
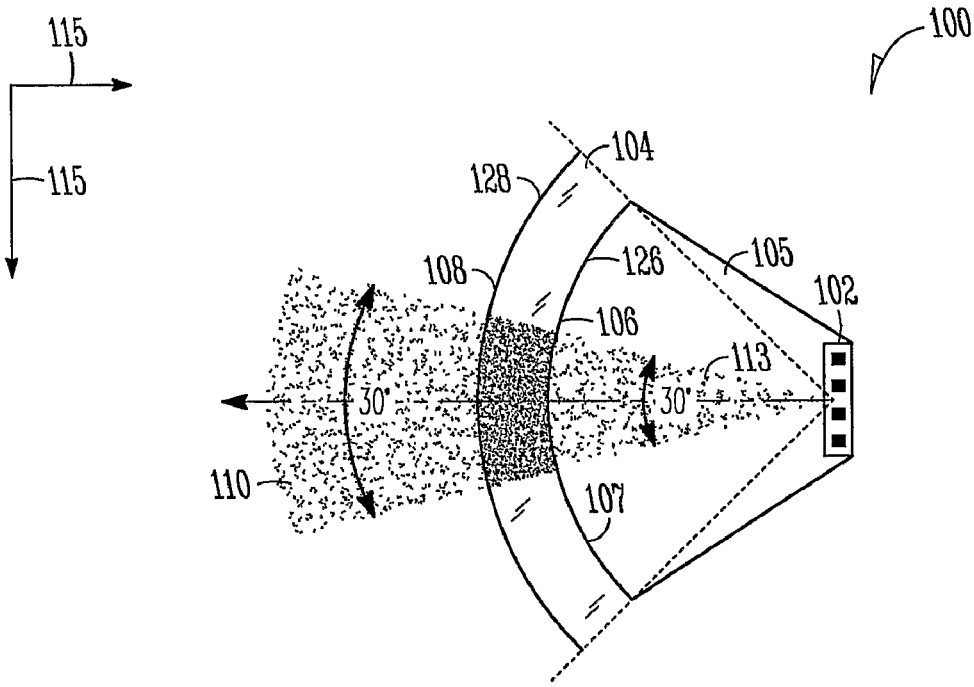
FIGS. 1A and 1B illustrate a chip-lens array antenna system in accordance with some embodiments of the present invention.
Figure 1B:
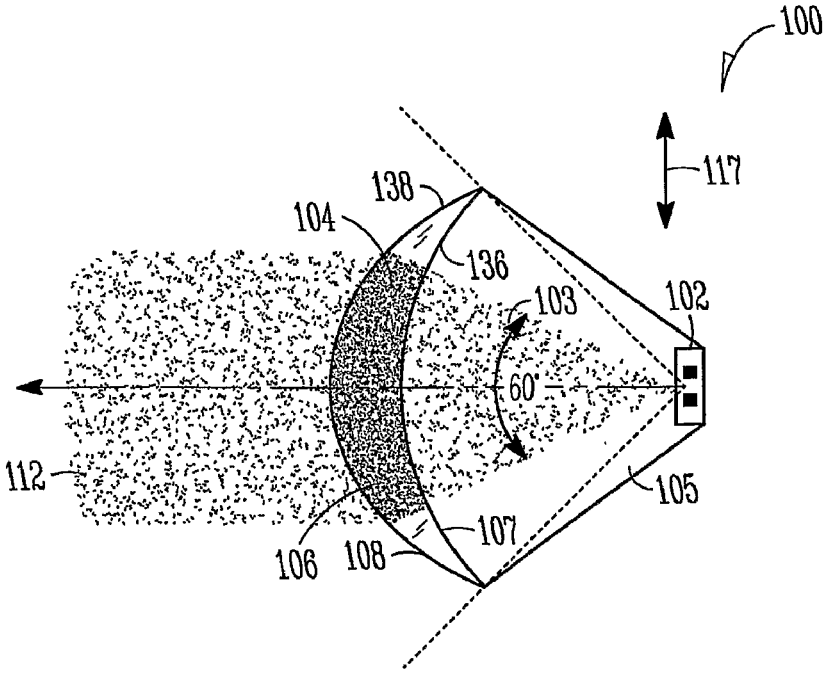

FIGS. 1A and 1B illustrate a chip-lens array antenna system in accordance with some embodiments of the present invention. Chip-lens array antenna system 100 comprises chip-array antenna 102 and millimeter-wave lens 104. FIG. 1A may illustrate a top-view of chip-lens array antenna system 100 and FIG. 1B may illustrate a side-view of chip-lens array antenna system 100. Chip-lens array antenna system 100 may generate diverging beam 110 in first plane 115 and may generate substantially non-diverging beam 112 in second plane 117.

Chip-array antenna 102 generates and directs an incident beam of millimeter-wave signals through millimeter-wave lens 104 for subsequent transmission to user devices. Millimeter-wave lens 104 has inner surface 106 and outer surface 108 with curvatures selected to provide diverging beam 110 in first plane 115 and substantially non-diverging beam 112 in second plane 117. In these embodiments, the incident beam of millimeter-wave signals directed by chip-array antenna 102 may be viewed as being squeezed in second plane 117 and may remain unchanged in first plane 115.

In some embodiments, inner surface 106 may be defined by substantially circular arc 126 in first plane 115 and substantially circular arc 136 in second plane 117. In the embodiments illustrated in FIGS. 1A and 1B, outer surface 108 may be defined by substantially circular arc 128 in first plane 115 and by elliptical arc 138 in second plane 117. In these embodiments, inner surface 106, when defined by a substantially circular arc in both first plane 115 and second plane 117, may comprise a substantially spherical inner surface, although the scope of the invention is not limited in this respect.

In some embodiments, first plane 115 may be a horizontal plane, second plane 117 may be a vertical plane, and diverging beam 110 may be a fan-shaped beam in the horizontal plane. In some embodiments, chip-array antenna 102 may generate wider incident beam 103 in the vertical plane and narrower incident beam 113 in the horizontal plane for incidence on inner surface 106 of millimeter-wave lens 104. Wider incident beam 103 may be converted to substantially non-diverging beam 112 by millimeter-wave lens 104, and narrower incident beam 113 may be converted to diverging beam 110 by millimeter-wave lens 104.

In the embodiments illustrated in FIGS. 1A and 1B, diverging beam 110 and narrower incident beam 113 may have approximately equal beamwidths when outer surface 108 is defined by substantially circular arc 128 in first plane 115. For example, in some embodiments, wider incident beam 103 in vertical plane 117 may have a beamwidth of sixty degrees as illustrated in FIG. 1B, while narrower incident beam 113 in horizontal plane 115 may have a beamwidth of thirty degrees as illustrated in FIG. 1A, although the scope of the invention is not limited in this respect. In these embodiments, wider incident beam 103, and narrower incident beam 113, may both be diverging beams. In horizontal plane 115, millimeter-wave lens 104 may have little or no effect on narrower incident beam 113, shown as having a beamwidth of thirty degrees, to provide diverging beam 110, which may also have a beamwidth of thirty degrees. In vertical plane 117, millimeter-wave lens 104 may convert wider incident beam 103 to substantially non-diverging beam 112.

In some embodiments, the beamwidths of wider incident beam 103 and narrower incident beam 113 may refer to the scanning angles over which chip-lens array antenna 102 may direct an incident beam to millimeter-wave lens 104. These embodiments may provide for a wide-angle scanning capability in the horizontal plane. The scanning angle and the beamwidth in the horizontal plane may both be determined by the dimensions of chip-array antenna 102, whereas the beamwidth in the vertical plane may be primarily determined by the vertical aperture size of millimeter-wave lens 104.

In some embodiments, chip-lens antenna 102 may scan or steer an incident beam within millimeter-wave lens 104 to scan or steer beams 110 and 112 outside of millimeter-wave lens 104, although the scope of the invention is not limited in this respect. These embodiments are discussed in more detail below.

In some embodiments, anti-reflective layer 107 may be disposed on inner surface 106 of millimeter-wave lens 104 to help reduce reflections of incident millimeter-wave signals transmitted by chip-array antenna 102. In some embodiments, anti-reflective layer 107 may be a layer of millimeter-wave transparent material comprising a material that is different than the material of millimeter-wave lens 104. The thickness of anti-reflective layer 107 may be selected so that millimeter-waves reflected from an incident surface of anti-reflective layer 107 and the millimeter-waves reflected from inner surface 106 (i.e., behind anti-reflective layer 107) may substantially cancel eliminating most or all reflected emissions. In some embodiments, thickness of anti-reflective layer 107 may be about a quarter-wavelength when the refraction index of anti-reflective layer 107 is between that of millimeter-wave lens 104 and the air, although the scope of the invention is not limited in this respect. In some embodiments, the thickness of anti-reflective layer 107 may be much greater than a wavelength. In some embodiments, one or more anti-reflective layers may be used to further suppress reflections, although the scope of the invention is not limited in this respect. In some embodiments, an anti-reflective layer or anti-reflective coating may be disposed on outer surface 108.

In some embodiments, anti-reflective layer 107 may comprise an anti-reflective coating, although the scope of the invention is not limited in this respect. In some embodiments, the use of anti-reflective layer 107 may reduce the input reflection coefficient so that when chip-lens array antenna system 100 is transmitting, any feedback as a result of reflections back to chip-array antenna 102 is reduced. This may help to avoid an undesirable excitation of the elements of chip-array antenna 102. The reduced feedback may also help improve the efficiency of chip-lens antenna system 100.

In some embodiments, chip-array antenna 102 comprises either a linear (i.e., one-dimensional) or planar (i.e., two-dimensional) array of individual antenna elements coupled to a radio-frequency (RF) signal path through control elements. The control elements may be used to control the amplitude and/or the phase shift between elements for steering the incident beam within the millimeter-wave lens. In some embodiments, when chip-array antenna 102 comprises a planar array of antenna elements, the control elements may set the amplitude and/or the phase shift for the antenna elements (e.g., to achieve a desired scanning angle) although the scope of the invention is not limited in this respect. In this way, wide and narrow incident beams of various beamwidths and scanning angles may be generated. In some embodiments, the rows of antenna elements may be controlled individually to direct the antenna beam.

In some embodiments, a linear phase-shift may be provided across the rows of the antenna elements. In some embodiments, an array-excitation function may be applied to the antenna elements of chip-array antenna 102 to achieve certain characteristics of the antenna beam, such as a particular power profile and/or side-lobe levels. For example, a uniform amplitude distribution across the array of antenna elements with linear phase shifts in the horizontal directional and with a constant phase in the vertical direction may be used to help achieve some of the characteristics of beams 110 and 112, although the scope of the invention is not limited in this respect. In some other embodiments, a Dolf-Chebyshev distribution or Gaussian power profile may be used for the amplitude and/or phase shifts across the antenna elements of chip-array antenna 102, although the scope of the invention is not limited in this respect.

Controlling the amplitude and/or phase difference between the antenna elements of chip-array antenna 102 may steer or direct the beams within a desired coverage area. It should be noted that the shape of millimeter-wave lens 104 provides for the characteristics of beams 110 and 112, while controlling and changing the amplitude and/or phase difference between the antenna elements may steer and direct the beams.

In some embodiments, the antenna elements of chip-array antenna 102 may comprise dipole radiating elements, although the scope of the invention is not limited in this respect as other types of radiating elements may also be suitable. In some embodiments, the antenna elements of chip-array antenna 102 may be configured in any one of a variety of shapes and/or configurations including square, rectangular, curved, straight, circular, or elliptical shapes.

In some embodiments, millimeter-wave lens 104 may be spaced apart from chip-array antenna 102 to provide cavity 105 therebetween. In some embodiments, cavity 105 may be air filled or filled with an inert gas. In other embodiments, cavity 105 may comprise a dielectric material having a higher permittivity and/or higher index of refraction at millimeter-wave frequencies than millimeter-wave lens 104. Due to the lower permittivity and/or lower index of refraction of the dielectric material that may be within cavity 105, less millimeter-wave reflections from inner surface 106 may result. In these embodiments, one or more foci may be implemented to help provide multiple antenna sectors, although the scope of the invention is not limited in this respect.

In some embodiments, millimeter-wave lens 104 may be made of a solid millimeter-wave dielectric material, such as a millimeter-wave refractive material having a relative permittivity ranging between 2 and 3 for a predetermined millimeter-wave frequency, although the scope of the invention is not limited in this respect. In some embodiments, cross-linked polymers, such as Rexolite, may be used for the millimeter-wave refractive material, although other polymers and dielectric materials, such as polyethylene, poly-4-methylpentene-1, Teflon, and high density polyethylene, may also be used. Rexolite, for example, may be available from C-LEC Plastics, Inc., Beverly, N.J., USA. In some embodiments, gallium-arsenide GaAs, quartz, and/or acrylic glass may be used for millimeter-wave lens 104. Any of these materials may also be selected for anti-reflective layer 107 provided that it is a different material and has a higher index of refraction than the material used for millimeter-wave lens 104. In some other embodiments, millimeter-wave lens 104 and/or anti-reflective layer 107 may comprise artificial dielectric materials and may be implemented, for example, as a set of metallic plates or metallic particles distributed within a dielectric material, although the scope of the invention is not limited in this respect.

In some embodiments, millimeter-wave lens 104 may comprise two or more layers of millimeter-wave dielectric material. In these embodiments, the millimeter-wave dielectric material of a first layer closer to chip-array antenna 102 may have a higher permittivity than the millimeter-wave dielectric material of a second layer, although the scope of the invention is not limited in this respect.

In some embodiments, the millimeter-wave signals transmitted and/or received by chip-lens antenna system 100 may comprise multicarrier signals having a plurality of substantially orthogonal subcarriers. In some embodiments, the multicarrier signals may comprise orthogonal frequency division multiplexed (OFDM) signals, although the scope of the invention is not limited in this respect. The millimeter-wave signals may comprise millimeter-wave frequencies between approximately 60 and 90 Gigahertz (GHz). In some embodiments, the millimeter-wave signals transmitted and/or received by chip-lens antenna system 100 may comprise single-carrier signals, although the scope of the invention is not limited in this respect.

Figure 2A:
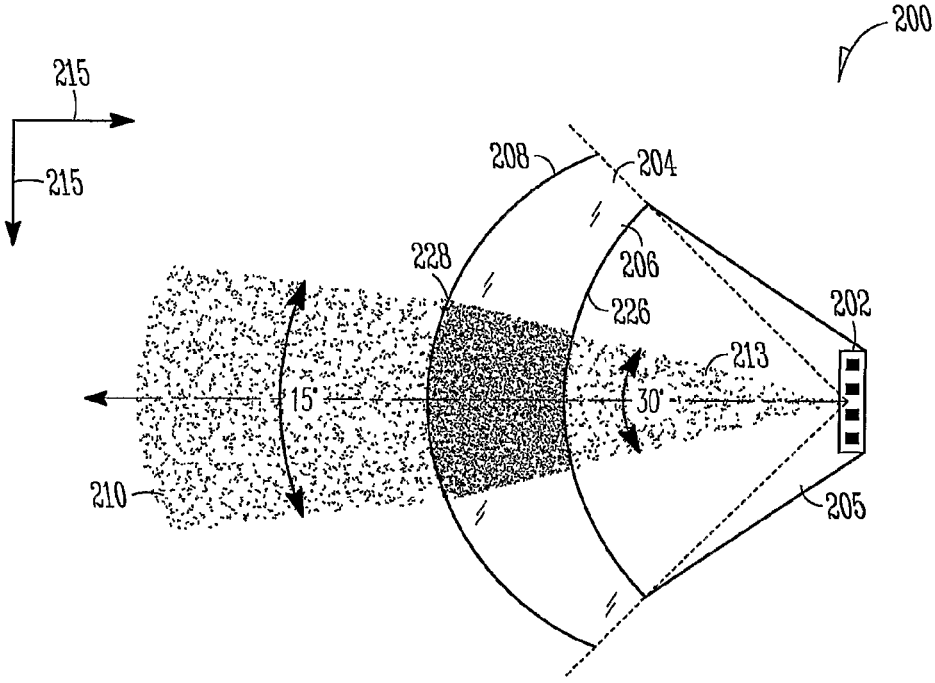
FIGS. 2A and 2B illustrate a chip-lens array antenna system in accordance with some embodiments of the present invention.
Figure 2B:
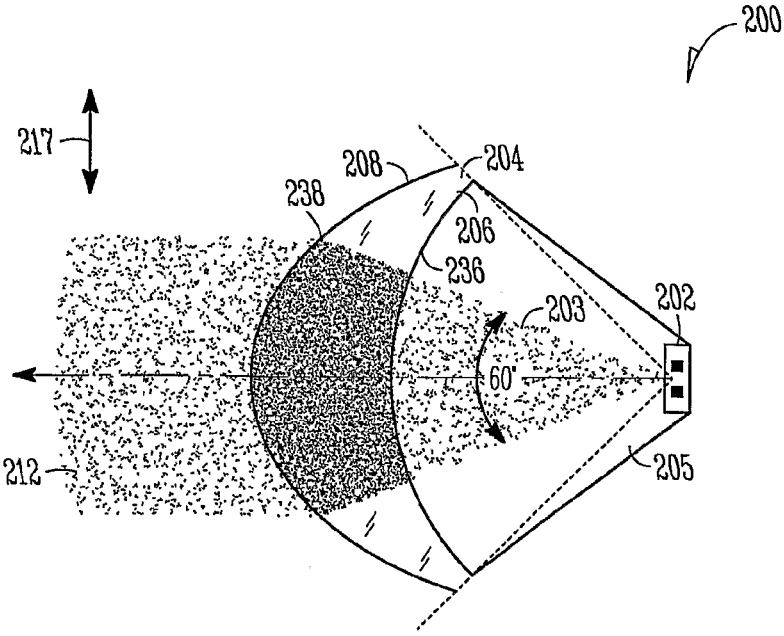

FIGS. 2A and 2B illustrate a chip-lens array antenna system in accordance with some embodiments of the present invention. Chip-lens array antenna system 200 comprises chip-array antenna 202 and millimeter-wave lens 204. FIG. 2A may illustrate a top-view of chip-lens array antenna system 200 and FIG. 2B may illustrate a side-view of chip-lens array antenna system 200. Chip-lens array antenna system 200 may generate diverging beam 210 in first plane 215 and may generate substantially non-diverging beam 212 in second plane 217.

In the embodiments illustrated in FIGS. 2A and 2B, outer surface 208 may be defined by elliptical arc 228 in first plane 215 and by elliptical arc 238 in second plane 217. Inner surface 206 may be defined by substantially circular arc 226 in first plane 215 and substantially circular arc 236 in second plane 217.

In the embodiments illustrated in FIGS. 2A and 2B, diverging beam 210 may have a substantially narrower beamwidth than narrower incident beam 213 when outer surface 208 is defined by elliptical arc 228 in first plane 215. In these embodiments, the incident beam of millimeter-wave signals directed by chip-array antenna 202 may be viewed as being squeezed in both second plane 217 and first plane 215, although the incident beam may be viewed as being squeezed less in first plane 215. In this way, chip-lens array antenna system 200 may provide a higher antenna gain with a smaller scanning angle in first plane 215 as compared to chip-lens array antenna system 100 (FIGS. 1A and 1B).

In the embodiments illustrated in FIGS. 2A and 2B, wider incident beam 203 and narrower incident beam 213 may both be diverging beams. In these embodiments in horizontal plane 215, millimeter-wave lens 204 may convert narrower incident beam 213, shown as having a beamwidth of approximately thirty degrees, to diverging beam 210 of a substantially reduced beamwidth, shown as having a beamwidth of approximately fifteen degrees. In vertical plane 217, millimeter-wave lens 204 may convert wider incident beam 203, shown as having a beamwidth of approximately sixty degrees, to substantially non-diverging beam 212. The selection of a particular elliptical arc in a particular plane may determine the beamwidth of a transmitted beam in that plane and whether the transmitted beam is diverging or non-diverging in that plane. In some embodiments, wider incident beam 203 and narrower incident beam 213 may refer to the scanning angles over which chip-lens array antenna 202 may direct an incident beam to millimeter-wave lens 204, although the scope of the invention is not limited in this respect.

In some embodiments illustrated in FIGS. 2A and 2B, outer surface 208 may be defined by first elliptical arc 228 in first plane 215 and defined by a second elliptical arc 238 in second plane 217. In these embodiments, first elliptical arc 228 may have a greater radius of curvature than second elliptical arc 238, and diverging beam 210 may be less diverging than incident beam 213 generated by chip-array antenna 202 in first plane 215 as a result of first elliptical arc 228 having a greater radius of curvature than second elliptical arc 238, although the scope of the invention is not limited in this respect. Elliptical arcs with a greater radius of curvature may refer to ellipses having foci that have a greater separation to provide a 'flatter' elliptical arc.

In some embodiments, cavity 205 may be provided between millimeter-wave lens 204 and chip-array antenna 202. As discussed above in reference to chip-lens array antenna system 100 (FIG. 1), cavity 205 may also be filled with either air or an inert gas, or alternatively, cavity 205 may comprise a dielectric material having a higher permittivity and/or higher index of refraction at millimeter-wave frequencies than millimeter-wave lens 204, although the scope of the invention is not limited in this respect. In some embodiments, millimeter-wave lens 204 may also comprise two or more layers of millimeter-wave dielectric material.

Figure 3:
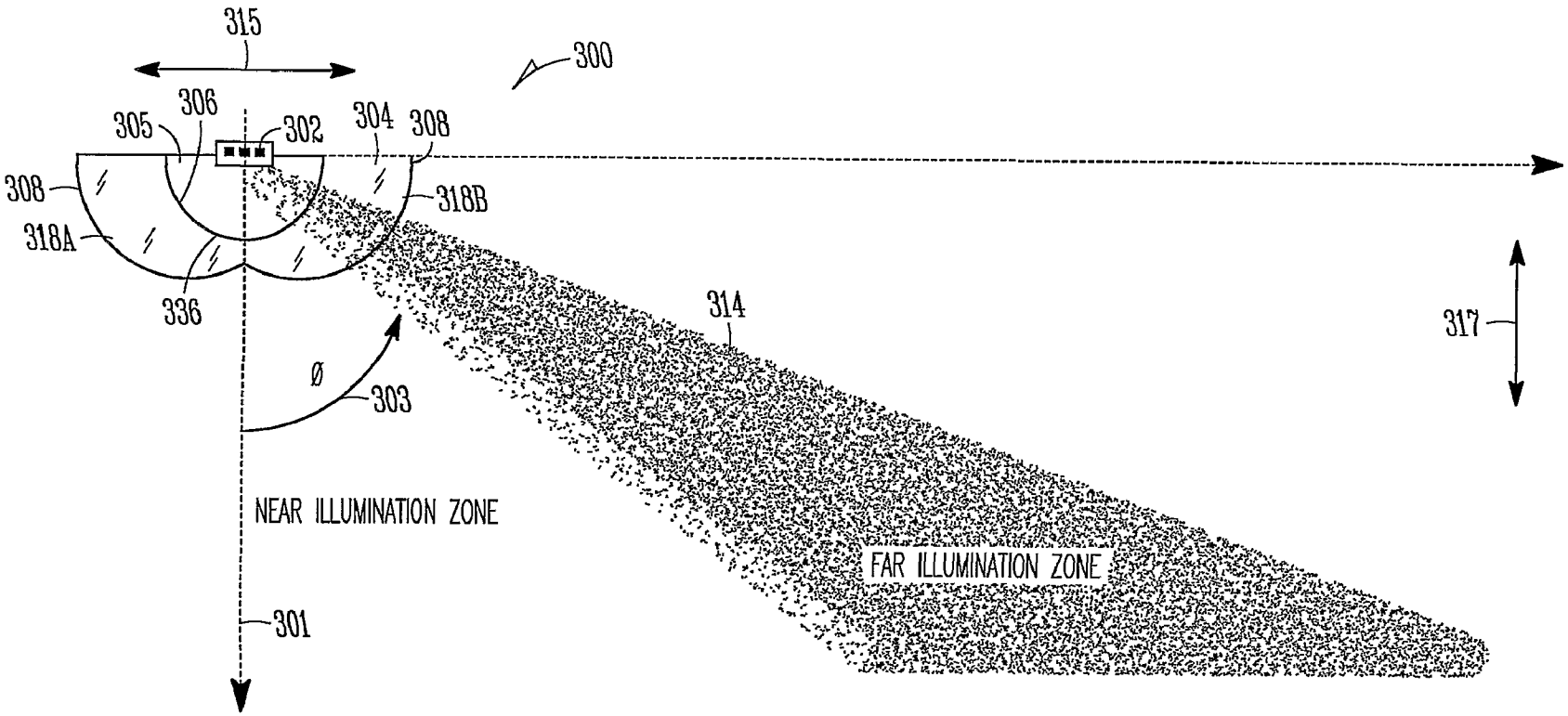
FIG. 3 illustrates a chip-lens array antenna system in accordance with some secant-squared embodiments of the present invention.

FIG. 3 illustrates a chip-lens array antenna system in accordance with some secant-squared ($sec^2$) embodiments of the present invention. FIG. 3 illustrates a side-view of chip-lens array antenna system 300. Chip-lens array antenna system 300 comprises millimeter-wave lens 304 and chip-array antenna 302. Chip-array antenna 302 may generate and direct an incident beam of millimeter-wave signals through millimeter-wave lens 304 for subsequent transmission to user devices. In these embodiments, millimeter-wave lens 304 may have substantially spherical inner surface 306 and may have outer surface 308 comprising first and second portions 318A and 318B. First and second portions 318A and 318B of outer surface 308 may be selected to provide a substantially omnidirectional pattern in first plane 315 and substantially secant-squared pattern 314 in second plane 317.

In some embodiments, inner surface 306 may be defined by substantially circular arc 336 in both horizontal plane 315 and vertical plane 317, and secant-squared pattern 314 may provide an antenna gain pattern that depends on elevation angle 303 to provide user devices with substantially uniform signal levels substantially independent of range. In these embodiments, the curve of outer surface 308 may represent a solution to a differential equation and may have neither a spherical, an elliptical, nor a parabolic shape. In some embodiments, the curve of outer surface 308 may be a generatrix curve in which a parameterization has been assigned based on the substantially secant-squared 314, although the scope of the invention is not limited in this respect.

In some embodiments, millimeter-wave lens 304 may be symmetric with respect to vertical axis 301. In other words, the shape of millimeter-wave lens 304 may be obtained by revolving around vertical axis 301, although the scope of the invention is not limited in this respect.

In some embodiments, first plane 315 may be a horizontal plane and second plane 317 may be a vertical plane. In these embodiments, a substantially omnidirectional pattern in the horizontal plane and substantially secant-squared pattern 314 in the vertical plane may provide one or more user devices with approximately the same signal power level substantially independent of the distance from millimeter-wave lens 304 over a predetermined range. In these embodiments, the substantially omnidirectional pattern in the horizontal plane and substantially secant-squared pattern 314 in the vertical plane may also provide one or more user devices with approximately the same antenna sensitivity for reception of signals substantially independent of the distance from millimeter-wave lens 304 over the predetermined range. In other words, user devices in the far illumination zone may be able to communicate just as well as user devices located in the near illumination zone.

In some embodiments, cavity 305 may be provided between millimeter-wave lens 304 and chip-array antenna 302. As discussed above in reference to chip-lens array antenna system 100 (FIG. 1), cavity 305 may also be filled with either air or an inert gas, or alternatively, cavity 305 may comprise a dielectric material having a higher permittivity and/or higher index of refraction at millimeter-wave frequencies than millimeter-wave lens 304, although the scope of the invention is not limited in this respect. In some embodiments, millimeter-wave lens 304 may also comprise two or more layers of millimeter-wave dielectric material.

Figure 4A:
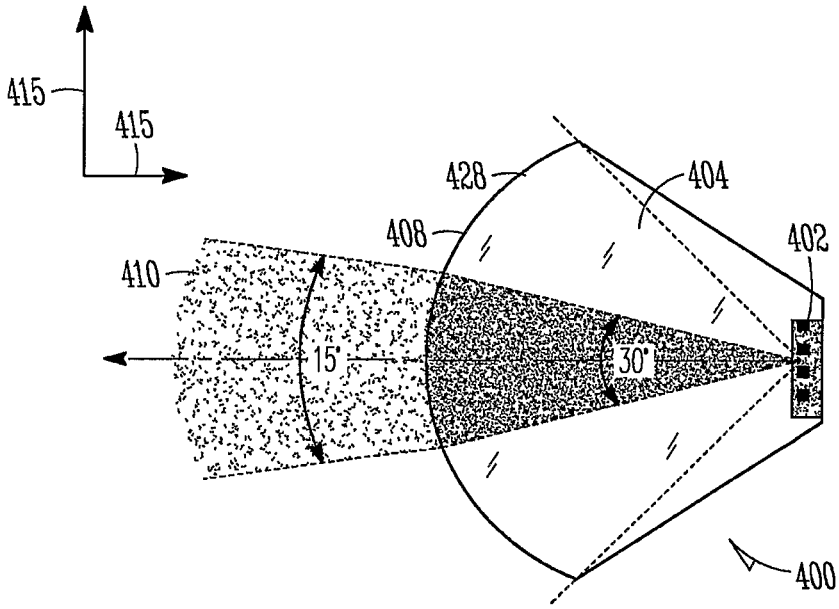
FIGS. 4A and 4B illustrate a chip-lens array antenna system in accordance with some fully-filled embodiments of the present invention.
Figure 4B:
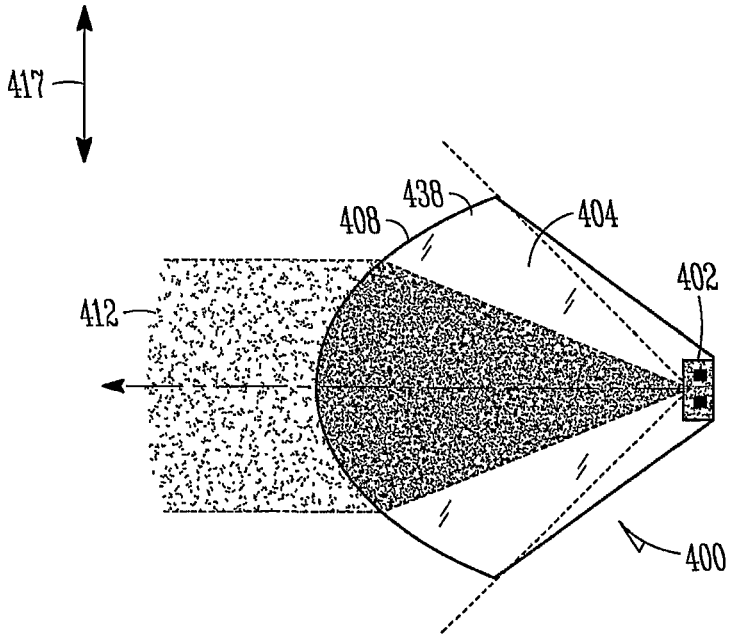

FIGS. 4A and 4B illustrate a chip-lens array antenna system in accordance with some fully-filled embodiments of the present invention. FIG. 4A may illustrate a top-view of chip-lens array antenna system 400 and FIG. 4B may illustrate a side-view of chip-lens array antenna system 400. In these embodiments, chip-lens array antenna system 400 includes chip-array antenna 402 and millimeter-wave refractive material 404 disposed over chip-array antenna 402. Chip-array antenna 402 generates and directs a beam of millimeter-wave signals within millimeter-wave refractive material 404 for subsequent transmission to one or more user devices. In these embodiments, millimeter-wave refractive material 404 has outer surface 408, which may be defined by either a substantially circular arc (not shown) or elliptical arc 428 in first plane 415, and elliptical arc 438 in second plane 417. This curvature may generate diverging beam 410 in first plane 415 and substantially non-diverging beam 412 in second plane 417.

In these fully-filled embodiments, chip-array antenna 402 may be at least partially embedded within millimeter-wave refractive material 404. Chip-lens array antenna system 400 may require less space than chip-lens array antenna system 100 (FIGS. 1A and 1B) or chip-lens array antenna system 200 (FIGS. 2A and 2B) when configured to achieve similar characteristics and when similar lens material is used. In some embodiments, up to a three times reduction in size may be achieved, although the scope of the invention is not limited in this respect. In some embodiments, the size of chip-array antenna 402 may be proportionally reduced while the beamwidth within refractive material 404 may remain unchanged because the wavelength of the millimeter-wave signals may be shorter within refractive material 404 than, for example, in air. This may help reduce the cost of chip-lens array antenna system 400. In these embodiments, the wavefront provided by chip-array antenna 402 may become more spherical and less distorted near outer surface 408. In these embodiments, millimeter-wave refractive material 404 may reduce distortion caused by the non-zero size of chip-array antenna 402 providing a more predictable directivity pattern. Furthermore, the absence of reflections from an inner surface may reduce the input reflection coefficient reducing unfavorable feedback to chip-array antenna 402.

In some embodiments, a non-reflective coating or layer may be provided over outer surface 408 to reduce reflections, although the scope of the invention is not limited in this respect. In some embodiments, millimeter-wave dielectric material 404 may comprise two or more layers of millimeter-wave dielectric material, although the scope of the invention is not limited in this respect.

Figure 5:
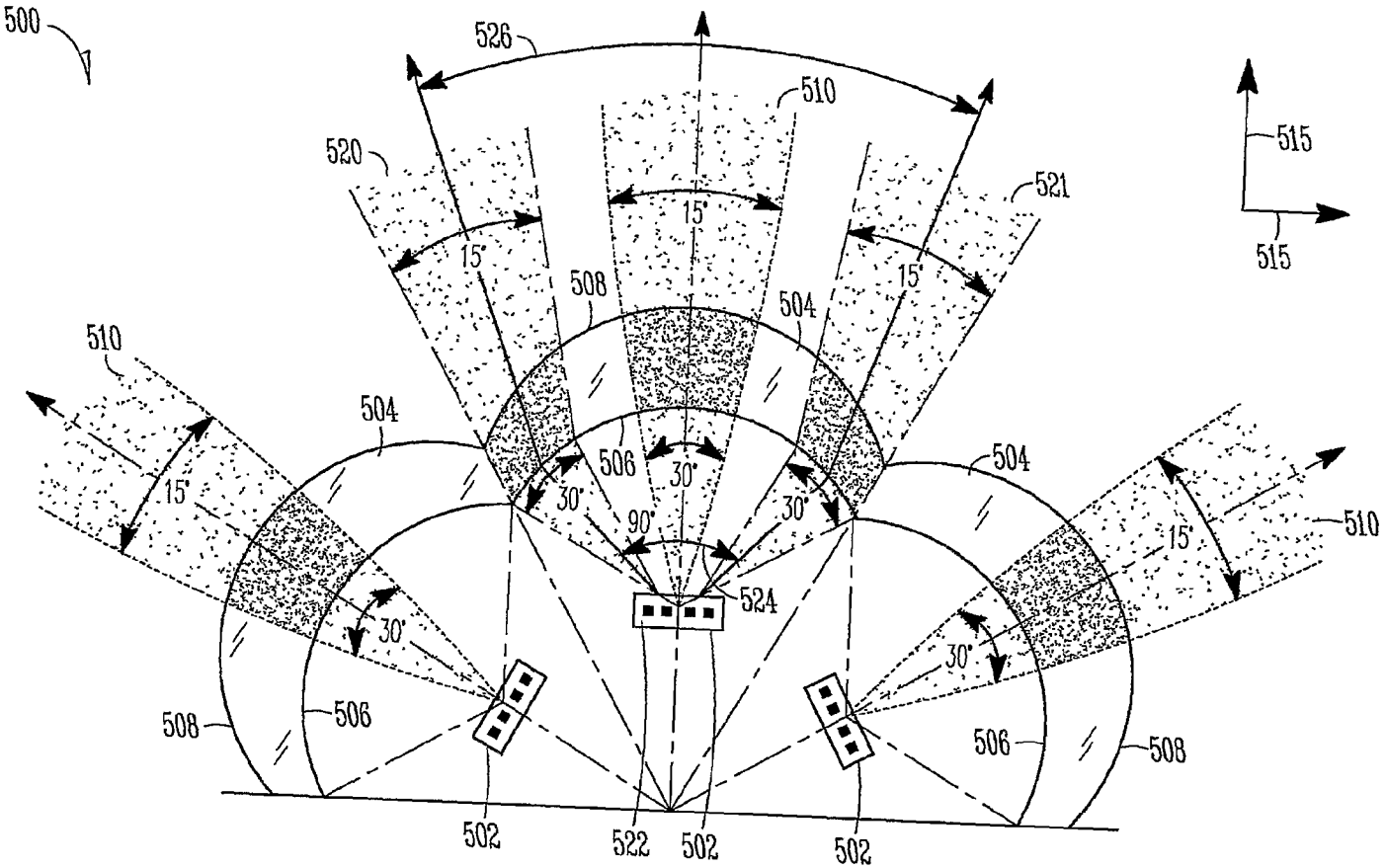
FIG. 5 illustrates a chip-lens array antenna system in accordance with some multi-sector embodiments of the present invention.

FIG. 5 illustrates a chip-lens array antenna system in accordance with some multi-sector embodiments of the present invention. FIG. 5 illustrates a top-view of multi-sector chip-lens array antenna system 500. Multi-sector chip-lens array antenna system 500 may comprise a plurality of millimeter-wave lens sections 504 and a plurality of chip-array antennas 502 to direct millimeter-wave signals through an associated one of millimeter-wave lens sections 504 for subsequent transmission to one or more user devices. In these multi-sector embodiments, each of millimeter-wave lens sections 504 may comprise inner surface 506 defined by arcs. Each of millimeter-wave lens sections 504 may also have outer surface 508 defined by either a substantially circular arc or an elliptical arc in first plane 515 and defined by an elliptical arc in a second plane. First plane 515 may be the horizontal plane and the second plane may be the vertical plane (i.e., perpendicular to or into the page), although the scope of the invention is not limited in this respect.

In some embodiments, the arcs used to define inner surfaces 506 and outer surfaces 508 may be elliptical, hyperbolic, parabolic, and/or substantially circular and may be selected to provide diverging beam 510 in first plane 515 and a substantially non-diverging beam in the second plane. In some multi-sector embodiments, each chip-array antenna 502, and one of millimeter-wave lens sections 504 may be associated with one sector of a plurality of sectors for communicating with the user devices located within the associated sector, although the scope of the invention is not limited in this respect In the example embodiments illustrated in FIG. 5, each sector may cover approximately sixty degrees of horizontal plane 515, and diverging beams 510 may have a fifteen-degree beamwidth in the horizontal plane. In these embodiments, chip-array antenna 502 may steer its beam within a thirty-degree beamwidth within lens 504 for scanning within a sixty-degree sector as illustrated to provide full coverage within each sector. In some other embodiments, each sector may cover approximately 120 degrees, although the scope of the invention is not limited in this respect.

In the example embodiments illustrated in FIG. 5, each of chip-array antennas 502 may illuminate millimeter-wave lens 504 with a thirty-degree beamwidth. Millimeter-wave lens 504 may downscale the beamwidth, for example, by a factor of two, to provide diverging beams 510 with a beamwidth of fifteen degrees external to millimeter-wave lens 504. This downscaling of the beamwidth may allow chip-array antennas 502 to provide a greater-radius coverage area when scanning. For example, chip-array antenna 522 may scan over scanning angle 524 (shown as ninety degrees) to cover a larger sector providing scanning angle 526 (shown as forty-five degrees) outside millimeter-wave lens 504 (i.e., from scanned beam 520 to scanned beam 521). In this example, a scanning angle of forty-five degrees outside millimeter-wave lens 504 may be downscaled from a ninety-degree scanning angle inside millimeter-wave lens 504. This may allow each chip-array antenna 502 to provide coverage over one of the sixty-degree sectors with a fifteen-degree beamwidth provided by each diverging beam 510. There is no requirement that the same antenna pattern and/or beamwidth be used in each sector. In some embodiments, different antenna patterns and/or beamwidths may be used in different sectors, although the scope of the invention is not limited in this respect.

In some embodiments, one or more cavities may be provided between millimeter-wave lens 504 and chip-array antennas 502. As discussed above in reference to chip-lens array antenna system 100 (FIG. 1), these cavities may be filled with either air or an inert gas, or alternatively, these cavities may comprise a dielectric material having a higher permittivity and/or higher index of refraction at millimeter-wave frequencies than millimeter-wave lens 504, although the scope of the invention is not limited in this respect. In some embodiments, millimeter-wave lens 504 may also comprise two or more layers of millimeter-wave dielectric material.

Referring to FIGS. 1A, 1B, 2A, 2B, 3, 4A, 4B and 5, chip-array antenna 102 may be suitable for use as chip-array antenna 202, chip-array antenna 302, chip-array antenna 402, and chip-array antenna 502. The materials described above for use in fabricating millimeter-wave lens 104 may also be suitable for in fabricating millimeter-wave lens 204, millimeter-wave lens 304 millimeter-wave lens refractive material 404 and the sections of millimeter-wave lens 504. In some embodiments, an anti-reflective layer or coating, such as anti-reflective layer 107, may be provided over the inner and/or outer surfaces of millimeter-wave lens 204, the inner and/or outer surfaces millimeter-wave lens 304, the outer surface of millimeter-wave lens material 404 and the inner and/or outer surfaces of the sections of millimeter-wave lens 504, although the scope of the invention is not limited in this respect.

Figure 6:
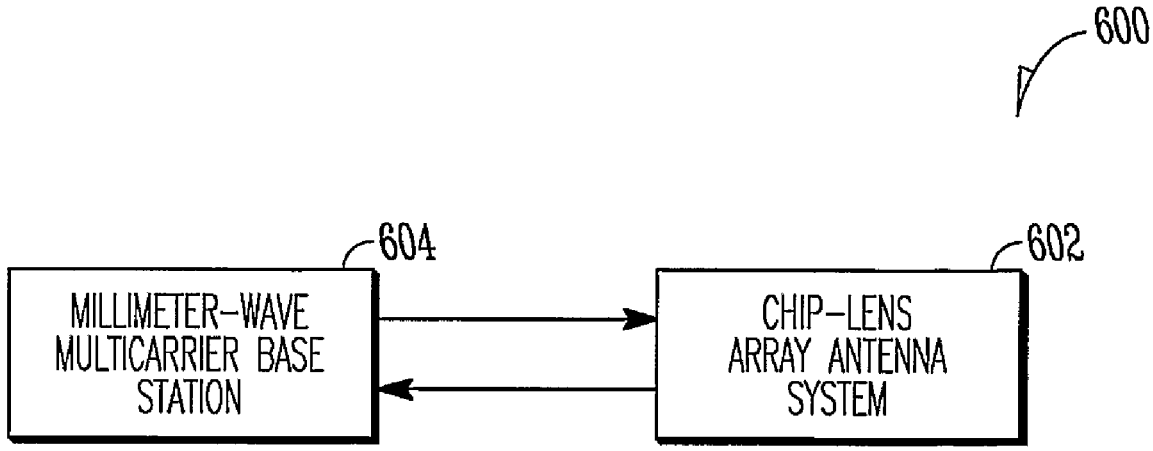
FIG. 6 illustrates a millimeter-wave communication system in accordance with some embodiments of the present invention.

FIG. 6 illustrates a millimeter-wave communication system in accordance with some embodiments of the present invention. Millimeter-wave communication system 600 includes millimeter-wave multicarrier base station 604 and chip-lens array antenna system 602. Millimeter-wave multicarrier base station 604 may generate millimeter-wave signals for transmission by chip-lens array antenna system 602 to user devices. Chip-lens array antenna system 602 may also provide millimeter-wave signals received from user devices to millimeter-wave multicarrier base station 604. In some embodiments, millimeter-wave multicarrier base station 604 may generate and/or process multicarrier millimeter-wave signals, although the scope of the invention is not limited in this respect. Chip-lens array antenna system 100 (FIGS. 1A and 1B), chip-lens array antenna system 200 (FIGS. 2A and 2B), chip-lens array antenna system 300 (FIG. 3), chip-lens array antenna system 400 (FIGS. 4A and 4B), or chip-lens array antenna system 500 (FIG. 5) may be suitable for use as chip-lens array antenna system 602.

As used herein, the terms 'beamwidth' and 'antenna beam' may refer to regions for either reception and/or transmission of millimeter-wave signals. Likewise, the terms 'generate' and 'direct' may refer to either the reception and/or transmission of millimeter-wave signals. As used herein, user devices may be a portable wireless communication device, such as a personal digital assistant (PDA), a laptop or portable computer with wireless communication capability, a web tablet, a wireless telephone, a wireless headset, a pager, an instant messaging device, a digital camera, an access point, a television, a medical device (e.g., a heart rate monitor, a blood pressure monitor, etc.), or other device that may receive and/or transmit information wirelessly. In some embodiments, user devices may include a directional antenna to receive and/or transmit millimeter-wave signals.

In some embodiments, millimeter-wave communication system 600 may communicate millimeter-wave signals in accordance with specific communication standards or proposed specifications, such as the Institute of Electrical and Electronics Engineers (IEEE) standards including the IEEE 802.15 standards and proposed specifications for millimeter-wave communications (e.g., the IEEE 802.15 task group 3c 'Call For Intent' dated December 2005), although the scope of the invention is not limited in this respect as they may also be suitable to transmit and/or receive communications in accordance with other techniques and standards. For more information with respect to the IEEE 802.15 standards, please refer to "IEEE Standards for Information Technology—Telecommunications and Information Exchange between Systems"—Part 15.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus, the following claims are hereby incorporated into the detailed description, with each claim standing on its own as a separate preferred embodiment.

What is claimed is:

1. A chip-lens array antenna system comprising:

a millimeter-wave lens; and a chip-array antenna to generate and direct an incident beam of millimeter-wave signals through the millimeter-wave lens for subsequent transmission, wherein the millimeter-wave lens has an inner surface and an outer surface with curvatures selected to provide a diverging beam in a first plane and a substantially non-diverging beam in a second plane.

2. The chip-lens array antenna system of claim 1 wherein the chip-array antenna comprises either a linear or planar array of antenna elements coupled to a millimeter-wave signal path through control elements, the control elements to control an amplitude and a phase shift between the antenna elements for steering the incident beam within the millimeter-wave lens.

3. The chip-lens array antenna system of claim 1 wherein the millimeter-wave lens is spaced apart from the chip-array antenna to provide a cavity therebetween, the cavity comprising a dielectric material having a higher permittivity than the millimeter-wave lens.

4. A chip-lens array antenna system comprising:

a millimeter-wave lens; and a chip-array antenna to generate and direct an incident beam of millimeter-wave signals through the millimeter-wave lens for subsequent transmission, wherein the millimeter-wave lens has an inner surface and an outer surface with curvatures selected to provide a diverging beam in a first plane and a substantially non-diverging beam in a second plane, wherein the inner surface is defined by substantially circular arcs in both the first plane and the second plane, wherein the outer surface is defined by either a substantially circular arc or an elliptical arc in the first plane and by an elliptical arc in the second plane, and wherein the millimeter-wave signals comprise multicarrier signals having a plurality of substantially orthogonal subcarriers comprising millimeter-wave frequencies between approximately 60 and 90 Gigahertz.

5. The chip-lens array antenna system of claim 4 further comprising an anti-reflective layer disposed on at least one of the inner surface or the outer surface of the millimeter-wave lens to help reduce reflections of millimeter-wave signals generated by the chip-array antenna.

6. A chip-lens array antenna system comprising:

a millimeter-wave lens; and a chip-array antenna to generate and direct millimeter-wave signals through the millimeter-wave lens for subsequent transmission, wherein the millimeter-wave lens has an inner surface, and has an outer surface defined by first and second portions, and wherein the first and second portions of the outer surface are selected to provide a substantially omnidirectional pattern in a first plane and a substantially secant-squared pattern in a second plane.

7. The chip-lens array antenna system of claim 6 wherein the first plane is a horizontal plane and the second plane is a vertical plane, wherein the inner surface is substantially spherical, and wherein the substantially omnidirectional pattern in the horizontal plane and the substantially secant-squared pattern in the vertical plane provides a signal power level substantially independent of a distance from the millimeter-wave lens over a predetermined range and further provides a signal-level sensitivity for receipt of signals substantially independent of the distance.

8. The chip-lens array antenna system of claim 6 wherein the chip-array antenna comprises either a linear or planar array of antenna elements coupled to a millimeter-wave signal path through control elements, the control elements to control an amplitude and a phase shift between the antenna elements for steering the incident beam within the millimeter-wave lens, wherein the millimeter-wave lens comprises a cross-linked polymer refractive material, and wherein the millimeter-wave signals comprise multicarrier signals having a plurality of substantially orthogonal subcarriers comprising millimeter-wave frequencies between approximately 60 and 90 Gigahertz.

9. The chip-lens array antenna system of claim 6 wherein the millimeter-wave lens is spaced apart from the chip-array antenna to provide a cavity therebetween, the cavity comprising a dielectric material having a higher permittivity than the millimeter-wave lens.

10. The chip-lens array antenna system of claim 6 wherein the millimeter-wave lens comprises at least first and second layers of millimeter-wave dielectric material, wherein the millimeter-wave dielectric material of the first layer has a higher permittivity than the millimeter-wave dielectric material of the second layer, and wherein the first layer is nearer to the chip-array antenna than the second layer.

11. A multi-sector chip-lens array antenna system comprising:

a plurality of millimeter-wave lens sections; and a plurality of chip-array antennas to direct millimeter-wave signals through an associated one of the millimeter-wave lens sections for subsequent transmission, wherein each of the millimeter-wave lens sections comprises an inner surface defined by partially circular arcs, and wherein each of the millimeter-wave lens sections has an outer surface defined by either a substantially circular arc or an elliptical arc in a first plane and defined by an elliptical arc in a second plane to provide a diverging beam in the first plane of each sector and to provide a substantially non-diverging beam in the second plane of each sector.

12. The multi-sector chip-lens array antenna system of claim 11 wherein each chip-array antenna and millimeter-wave lens section is associated with one sector of a plurality of sectors for communicating, and further comprising an anti-reflective layer disposed on at least one of the inner surface or the outer surface of the millimeter-wave lens to help reduce reflections of millimeter-wave signals generated by the chip-array antenna.

13. The multi-sector chip-lens array antenna system of claim 11 wherein each chip-array antenna comprises either a linear or planar array of antenna elements coupled to a millimeter-wave signal path through control elements, the control elements to control an amplitude and a phase shift between the antenna elements for steering the incident beam within the millimeter-wave lens, wherein the millimeter-wave lens comprises a cross-linked polymer refractive material, and wherein the millimeter-wave signals comprise multicarrier signals having a plurality of substantially orthogonal subcarriers comprising millimeter-wave frequencies between approximately 60 and 90 Gigahertz.

14. The multi-sector chip-lens array antenna system of claim 11 wherein the millimeter-wave lens is spaced apart from the chip-array antenna to provide a cavity therebetween, the cavity comprising a dielectric material having a higher permittivity than the millimeter-wave lens.

15. The multi-sector chip-lens array antenna system of claim 11 wherein the millimeter-wave lens comprises at least first and second layers of millimeter-wave dielectric material, wherein the millimeter-wave dielectric material of the first layer has a higher permittivity than the millimeter-wave dielectric material of the second layer, and wherein the first layer is nearer to the chip-array antenna than the second layer.

16. A chip-lens array antenna system comprising:

a chip-array antenna; and a millimeter-wave refractive material disposed over the chip-array antenna, the chip-array antenna to generate and direct millimeter-wave signals within the millimeter-wave refractive material for subsequent transmission, wherein the millimeter-wave refractive material has an outer surface defined by either a substantially circular arc or an elliptical arc in a first plane and an elliptical arc in a second plane to generate a diverging beam in the first plane and a substantially non-diverging beam in the second plane.

17. The chip-lens array antenna system of claim 16 wherein the chip-array antenna is at least partially embedded within the millimeter-wave dielectric material, and wherein the millimeter-wave dielectric material comprises a cross-linked polymer refractive material.

18. A chip-lens array antenna system comprising:

a chip-array antenna; and a millimeter-wave refractive material disposed over the chip-array antenna, the chip-array antenna to generate and direct millimeter-wave signals within the millimeter-wave refractive material for subsequent transmission, wherein the millimeter-wave refractive material has an outer surface defined by either a substantially circular arc or an elliptical arc in a first plane and an elliptical arc in a second plane to generate a diverging beam in the first plane and a substantially non-diverging beam in the second plane, and wherein an anti-reflective layer is disposed on at least one of the inner surface or the outer surface of the millimeter-wave lens to help reduce reflections of millimeter-wave signals generated by the chip-array antenna.

19. The chip-lens array antenna system of claim 16 wherein the chip-array antenna comprises either a linear or planar array of antenna elements coupled to a millimeter-wave signal path through control elements, the control elements to control an amplitude and a phase shift between the antenna elements for steering the incident beam within the millimeter-wave lens, and wherein the millimeter-wave signals comprise multicarrier signals having a plurality of substantially orthogonal subcarriers comprising millimeter-wave frequencies between approximately 60 and 90 Gigahertz.

20. The chip-lens array antenna system of claim 16 wherein the millimeter-wave lens comprises at least first and second layers of millimeter-wave dielectric material, wherein the millimeter-wave dielectric material of the first layer has a higher permittivity than the millimeter-wave dielectric material of the second layer, and wherein the first layer is nearer to the chip-array antenna than the second layer.

* * * * *

UNITED STATES PATENT AND TRADEMARK OFFICE

CERTIFICATE OF CORRECTION

PATENT NO. : 8,193,994 B2
APPLICATION NO. : 12/301693
DATED : June 5, 2012
INVENTOR(S) : Alamouti et al.

It is certified that error appears in the above-identified patent and that said Letters Patent is hereby corrected as shown below:

On the face page 2, under "US Patent Documents", in column 2, line 10, in the citation for US Patent 7,948,428 B2, after "7,948,428 B2 5/2011 Lovberg et al.", insert --8,149,178 4/2012 Alamouti et al.--, therefor On the face page 2, under "US Patent Documents", in column 2, line 53, in the citation for US Patent 2010/0231452 A1, after "2010/0231452 A1 9/2010 Babakhani et al.", insert --2010/0214150 A1 8/2010 Lovberg et al.--, therefor On the face page 2, under "Foreign Patent Documents", in column 2, line 2, in the citation for Foreign Patent EP 0212963, after "DE 03840451 6/1990", delete "EP 0212963 3/1987"

On the face page 2, under "Foreign Patent Documents", in column 2, line 11, in the citation for Foreign Patent JP 08-084107, after "JP 06200584 7/1994", delete "JP 08-084107 3/1996"

On the face page 2, under "Foreign Patent Documents", in column 2, line 15, in the citation for Foreign Patent JP 11055174, after "JP 11055174 A 2/1999", insert --JP 2000307494 11/2000--, therefor On the face page 2, under "Foreign Patent Documents", in column 2, line 21, in the citation for Foreign Patent KR 20060029001, after "KR 20060029001 4/2006", insert --JP 2006148928 A 6/2006--, therefor On the face page 2, under "Other Publications", in column 2, line 5, after Office Action, delete "Mailed", and insert --mailed--, therefor On the face page 2, under "Other Publications", in column 2, line 6, delete "5." and insert --5 pgs.--, therefor Signed and Sealed this
Ninth Day of October, 2012

David J. Kappos

David J. Kappos
*Director of the United States Patent and Trademark Office*

On the face page 2, under "Other Publications", in column 2, line 8, delete "3." and insert --3 pgs.--, therefor On the face page 2, under "Other Publications", in column 2, line 8-9, delete "multiple beam" and insert --multiple-beam--, therefor On the face page 2, under "Other Publications", in column 2, line 14, delete "E.L.,", and insert --E. L.,--, therefor On the face page 2, under "Other Publications", in column 2, line 17, delete "efficeint", and insert --efficient--, therefor On the face page 2, under "Other Publications", in column 2, line 19, delete "2003," and insert --2003.--, therefor On the face page 2, under "Other Publications", in column 2, line 23, delete "2003.," and insert --2003.--, therefor On the face page 2, under "Other Publications", in column 2, line 31, delete "mailed" and insert --filed--, therefor On the face page 3, under "Other Publications", in column 1, line 28, delete "17 pg." and insert --17 pgs.--, therefor On the face page 3, under "Other Publications", in column 1, line 29, After ""International Application Serial No. PCT/US2007/070588, International Search Report and Written Opinion mailed Oct. 25, 2007", 10 pgs." insert
--"U.S. Appl. No. 11/452,710, Response filed Mar. 23, 2012 to Non Final Office Action Dec. 23, 2011" 15 pgs.

"U.S. Appl. No. 11/452,710, Non Final Office Action mailed Dec. 23, 2011", 16 pgs.

"U.S. Appl. No. 11/452,710, Notice of Allowance mailed Apr. 13, 2012", 8 pgs.

"U.S. Appl. No. 12/301,669, Notice of Allowance mailed Jan 30, 2012", 8 pgs.

"Chinese Application Serial No. 200680054314.3, Office Action Response filed Nov. 21, 2011", 14 pgs.

"Chinese Application Serial No. 200680054323.2, Office Action mailed Jan 18, 2012", 13 pgs.

"Chinese Application Serial No. 200680054334.0, Office Action Response filed Jan 17, 2012", 31 pgs.

"Chinese Application Serial No. 200780017307.0, Office Action mailed Dec 31, 2011", 8 pgs.

Japanese Application Serial No. 2009-515577, Final Office Action mailed Jan 31, 2012", w/English Translation, 6 pgs.--, therefor In column 10, line 36, in Claim 2, after "claim 1", insert --,--, therefor In column 10, line 43, in Claim 3, after "claim 1", insert --,--, therefor In column 10, line 66, in Claim 5, after "claim 4", insert --,--, therefor In column 11, line 16, in Claim 7, after "claim 6", insert --,--, therefor In column 11, line 28, in Claim 8, after "claim 6", insert --,--, therefor In column 11, line 42, in Claim 9, after "claim 6", insert --,--, therefor In column 11, line 47, in Claim 10, after "claim 6", insert --,--, therefor In column 12, line 5, in Claim 12, after "claim 11", insert --,--, therefor In column 12, line 15, in Claim 13, after "claim 11", insert --,--, therefor In column 12, line 28, in Claim 14, after "claim 11", insert --,--, therefor In column 12, line 33, in Claim 15, after "claim 11", insert --,--, therefor In column 12, line 33, in Claim 17, after "claim 16", insert --,--, therefor In column 13, line 8, in Claim 19, after "claim 16", insert --,--, therefor In column 14, line 5, in Claim 20, after "claim 16", insert --,--, therefor